US008505753B2

(12) United States Patent
Clark et al.

(10) Patent No.: US 8,505,753 B2
(45) Date of Patent: Aug. 13, 2013

(54) DISPLAY APPARATUS AND METHOD

(75) Inventors: Jeremy A. Clark, Minneapolis, MN (US); Michael A. Whittier, Minneapolis, MN (US); David Cheney, St. Paul, MN (US); Joseph R. Guggenberger, Elk River, MN (US)

(73) Assignee: Target Brands, Inc., Minneapolis, MN (US)

( * ) Notice: Subject to any disclaimer, the term of this patent is extended or adjusted under 35 U.S.C. 154(b) by 462 days.

(21) Appl. No.: 12/487,082

(22) Filed: Jun. 18, 2009

(65) Prior Publication Data

US 2010/0320164 A1 Dec. 23, 2010

(51) Int. Cl.
*A47B 43/00* (2006.01)
*A47B 47/00* (2006.01)

(52) U.S. Cl.
USPC ..... 211/189; 211/186

(58) Field of Classification Search
USPC ..... 211/189, 187, 59.2, 175, 86.01, 186, 211/188, 194; 108/107, 55.1, 106; 40/610, 40/575; 52/287.1, 239, 716.1, 479, 481.2, 52/483.1, 36.5, 36.6, 238.1, 364, 474
See application file for complete search history.

(56) References Cited

U.S. PATENT DOCUMENTS 2,688,525 A * 9/1954 Lindstrom ..... 312/140.1
2,987,195 A * 6/1961 Smith ..... 211/175
3,110,531 A * 11/1963 Nowicki ..... 312/140.3
3,115,719 A * 12/1963 Mapson ..... 40/553
3,200,961 A * 8/1965 Kolster et al. ..... 211/186
3,226,172 A * 12/1965 Bateman ..... 312/140.1
3,468,592 A * 9/1969 Madey ..... 312/140.3
4,655,352 A * 4/1987 Noyes et al. ..... 211/175
4,876,835 A 10/1989 Kelley et al.
4,930,642 A * 6/1990 Brooks et al. ..... 211/85.31
5,078,283 A 1/1992 Wilson
5,224,610 A * 7/1993 Veazey ..... 211/87.01
5,255,803 A 10/1993 Pavone et al.
5,624,044 A * 4/1997 Black, Jr. ..... 211/186
5,664,690 A 9/1997 Friesen
5,687,498 A * 11/1997 Keyser et al. ..... 40/518
5,794,782 A 8/1998 Ascik
5,921,190 A 7/1999 Wood
5,956,876 A 9/1999 Burdette et al.
6,003,697 A * 12/1999 Ferchat et al. ..... 211/189
6,062,399 A * 5/2000 Henry et al. ..... 211/103
6,405,880 B1 * 6/2002 Webb ..... 211/59.2
6,481,132 B1 * 11/2002 Grate et al. ..... 40/575

(Continued)

FOREIGN PATENT DOCUMENTS

JP 11285429 10/1997
JP 9276097 A 10/1999

*Primary Examiner* — Jonathan Liu
*Assistant Examiner* — Patrick Hawn
(74) *Attorney, Agent, or Firm* — Griffiths & Seaton PLLC; JoAnn M. Seaton

(57) ABSTRACT

Some embodiments of a display apparatus can present a variety of products or images of available products in an appealing manner that draws attention from consumers. In particular circumstances, the display apparatus may be readily changed by a store worker from a first configuration to a second configuration having a different appearance. For example, the display apparatus may include a generally rigid frame that receives a decorative, external sheathing in a toolless manner. Such a configuration can be useful, for example, for endcap display fixtures that are positioned at the end of store aisles, thereby providing an opportunity to promptly change the appearance of one or more endcaps and the products exhibited thereon.

15 Claims, 11 Drawing Sheets

(56) References Cited

U.S. PATENT DOCUMENTS

| | | | | |
|---|---|---|---|---|
| 6,687,037 | B2 * | 2/2004 | Hendriks et al. | 359/204.1 |
| 6,854,814 | B1 * | 2/2005 | Gardner et al. | 312/138.1 |
| 6,883,671 | B2 | 4/2005 | Rushing | |
| 6,915,914 | B2 | 7/2005 | Farrand | |
| 7,048,131 | B2 * | 5/2006 | Gay et al. | 211/187 |
| 7,234,604 | B2 * | 6/2007 | Eisele | 211/187 |
| 7,252,200 | B1 | 8/2007 | Hester | |
| 7,374,052 | B2 * | 5/2008 | Price et al. | 211/86.01 |
| 7,444,773 | B2 | 11/2008 | Kolodziejczak, Sr. | |
| 7,500,574 | B1 * | 3/2009 | Miller et al. | 211/106 |
| 2002/0033372 | A1 * | 3/2002 | Kellogg | 211/13.1 |
| 2005/0230338 | A1 * | 10/2005 | Farinola et al. | 211/186 |
| 2006/0091092 | A1 * | 5/2006 | Vosbikian | 211/87.01 |
| 2006/0213850 | A1 * | 9/2006 | VanCalbergh et al. | 211/94.01 |
| 2007/0170137 | A1 * | 7/2007 | Thelwell | 211/183 |
| 2008/0029676 | A1 * | 2/2008 | Huxtable et al. | 248/345.1 |

* cited by examiner

DISPLAY APPARATUS AND METHOD

TECHNICAL FIELD

This disclosure relates to a product display apparatus for presenting items, for example, in a retail store environment.

BACKGROUND

Display fixtures can be used in retail stores or other environments to present various products to consumers. The display fixtures may retain the product packages therein in view of the consumers. For example, cosmetics, apparel items, fashion accessories, magazines, and other products may be displayed in trays or shelves of a designated display fixture. Such a display fixture can be arranged along an aisle in a store so that consumers walking by the display fixture can readily grasp selected products.

In some circumstances, the display fixture may be replaced or moved to a different location so as to change the appearance of the store aisle or area. This may be particularly true for display fixtures arranged at the end of a store aisle, which are commonly referred to as endcap fixtures.

The endcap fixtures may be replaced or moved within a store for a number of reasons. In some instances, a seasonal endcap display fixture may replace a standard endcap display fixture to promote a particular seasonal sales event, such as a holiday sale. Also, a store may periodically replace or remove endcap display fixtures in response to promotions for particular product sets. For example, an endcap display fixture can be configured to promote a particular type of cosmetic product that is promoted during a first week, and the fixture can be moved or replaced to promote a different pharmaceutical product during a second week.

The time and labor required to move or reassemble a display fixture can be substantial. Moreover, store workers may not have access to specialized tools required for assembly or disassembly of particular store fixtures.

SUMMARY

Some embodiments of a display apparatus can present a variety of products or images of available products in an appealing manner that draws attention from consumers. In particular circumstances, the display apparatus may be readily changed by a store worker from a first configuration to a second configuration having a different appearance. For example, the display apparatus may include a generally rigid frame that receives a decorative, external sheathing in a toolless manner. As such, the store worker may efficiently mount the decorative sheathing to the frame to provide an appearance related to a selected set of products. Such a configuration can be useful, for example, for endcap display fixtures that are positioned at the end of store aisles, thereby providing an opportunity to promptly change the appearance of one or more endcaps and the products exhibited thereon.

In particular embodiments, an endcap display apparatus for abutment with an end of a retail shelving unit may include a lower support platform and a rigid internal frame. The rigid internal frame may extend upward from the lower support platform and may include a plurality of vertical and horizontal frame members. The apparatus may also include a first set of flexible external sheathing members toollessly mounted to the rigid internal frame so that the flexible external sheathing members conceal at least a portion of the rigid internal frame and define one or more product display structures to receive a plurality of products. Each of the flexible external sheathing members may include at least one toolless mounting connector to releasably engage the flexible sheathing member a corresponding one of the vertical and horizontal frame members.

Some embodiments of a product display apparatus may include a base deck and an internal frame structure extending upward from the base deck. The internal frame structure may include an assembly of rigid frame shafts coupled to one another. The apparatus may also include flexible covering panels slidably and releasably engaged with the internal frame structure so that the flexible covering panels conceal the internal frame structure and define a plurality of decorative exterior surfaces to receive and display products. The apparatus may further include friction-fit mounting channels coupled to the flexible covering panels opposite of the decorative exterior surfaces so as to toollessly mount the flexible covering panels to the internal frame structure. The base deck may have a length and a width substantially greater than the internal frame structure and the flexible covering panels mounted thereto, thereby defining a front extending portion and side extending portions of the base deck that extend outwardly beyond the internal frame structure and the flexible covering panels mounted thereto.

Further embodiments may include a method of using a display fixture, such as an endcap display fixture. The method may include toollessly removing a first set of decorative sheathing members from a substantially concealed frame structure extending upward from a base of an endcap display fixture. The method may also include toollessly mounting a second set of decorative sheathing members to the frame structure of the endcap display fixture. The second set of decorative sheathing members may have a different appearance than the first set of decorative sheathing members. The method may further include mounting a plurality of products onto display surfaces or into display windows defined by the second set of decorative sheathing members. At least one of the second set of decorative sheathing members may include an image viewable on an exterior surface that is related to one or more of the products mounted onto the display surfaces or into the display windows.

These and other embodiments described herein may provide one or more of the following benefits. First, some embodiments of the display apparatus described herein can be configured to display a variety of products, images related to available products, or a combination thereof. Second, the display fixture can include a plurality of decorative sheathing members that are toollessly mounted to internal frame members of the fixture. As such, the sheathing members can provide attractive appearance to consumers that may include marketing graphics while also defining as mechanical support structures for the products displayed on the fixture. Third, a store worker can readily change the configuration of the display fixture from a first configuration to a second configuration without requiring handheld tools. For example, the store worker can efficiently remove a first set of the flexible sheathing members from the internal frame structure and then mount a different set of flexible sheathing members to the internal frame structure to provide a different appearance related to a second selected set of products. Fourth, the convertible display fixtures described herein can be arranged as endcap displays positioned at the ends of store aisles, thereby providing an opportunity to promptly change the appearance of a store without requiring replacement or removal of display fixtures. Some or all of these and other benefits may be provided by the apparatus and methods described herein.

The details of one or more embodiments of the invention are set forth in the accompanying drawings and the description below. Other features, objects, and advantages of the invention will be apparent from the description and drawings, and from the claims.

DETAILED DESCRIPTION OF ILLUSTRATIVE EMBODIMENTS

Figure 1:
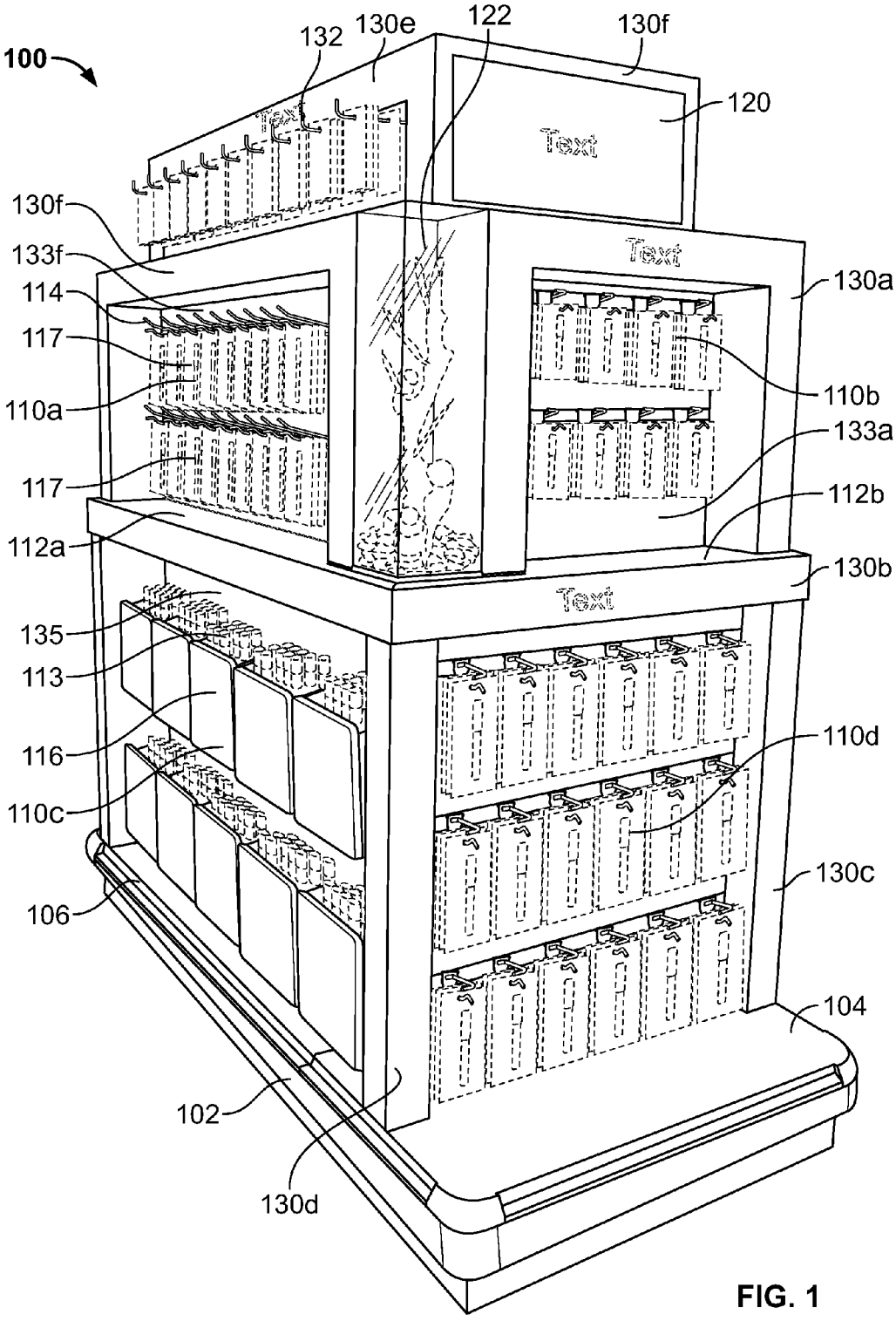
FIG. 1 is a perspective view of a display apparatus, in accordance with some embodiments.

Referring to FIG. 1, some embodiments of an endcap display fixture 100 can be configured to display a variety of products, images related to available products, or a combination thereof. The display fixture 100 can be placed along a shopping aisle or at the end of the aisle in a retail store to allow consumers to readily view products or images of products displayed by the display fixture 100. For example, the display fixture 100 can be positioned at the end of a retail shelving unit to serve as an endcap fixture to the shelving unit at the end of a shopping aisle.

As described in more detail below, the display fixture 100 can include a plurality of flexible sheathing members 130 that are toollessly mounted to an internal frame structure 140. The flexible sheathing members 130 can provide a decorative and pleasing appearance to consumers while also serving as mechanical support structures for the products displayed on the display fixture 100. Moreover, the flexible sheathing members 130 enable a store worker to readily change the configuration of the display fixture from a first configuration 100 (FIG. 1) to a second configuration 200 (FIG. 11) without requiring handheld tools. As such, the store worker can efficiently mount the flexible sheathing members 130 to the internal frame structure 140 to provide an appearance related to a selected set of products. The store worker can then remove the flexible sheathing members 130 from the internal frame structure 140 and mount a different set of flexible sheathing members to the internal frame structure 140 (e.g. flexible sheathing members 230 discussed below with reference to FIG. 11) to provide a different appearance related to a second selected set of products. Such a configuration can be useful, for example, for endcap display fixtures that are positioned at the end of store aisles, thereby providing an opportunity to promptly change the appearance of one or more endcaps and the products exhibited thereon.

The display fixture 100, in this embodiment, includes a number of display windows 110*a-d* and shelves 112*a-b* that display a variety of products or images related to the products. For example, in this embodiment, the display window 110*a* can at least partially be defined by a sheathing member 130*f* that includes an integrated vertical panel 133*f* having one or more hooks 114. The hooks 114 can extend from the vertical panel 133*f* and retain and display a variety of retail products 117. For example, packages containing eyeliner pencils in a variety of shades can be hung from the hooks 114. As another example, packages containing a variety of office supplies can be hung from the hooks 114. In other embodiments, the vertical panel 133*f* is not integrated with the sheathing member 130*f*, but instead includes a number of rearwardly extending tabs that are configured to be received by apertures 146 (FIG. 2) of the internal frame structure 140.

In some embodiments, the display windows 110*a-d* can include images of available products or images relating to products. For example, the display window 110*b* can include a sign on an exterior of the sheathing member 130*a* that displays images of available cosmetic products. As another example, the display window 110*b* can include a sign on an exterior of the sheathing member 130*a* that displays one or more images of logos or brand names related to products displayed by other portions of the display fixture 100. In some embodiments, the display windows 110*a-d* can include signs with one or more images or graphics to enhance the aesthetics of the display fixture 100. For example, the hooks 114 can retain and display a variety of squirt guns, toy shovels, toy buckets, and other outdoor related toys. In this example, the display window 110*b* can include a sign with an image of children playing on a beach.

Still referring to FIG. 1, in some embodiments, the display windows 110*a-d* can include one or more product containers for retaining and displaying various products. For example, the display window 110*c* can include a plurality of container bins 116 for displaying products 118. In some embodiments, the container bins 116 can extend forward from a sheathing member 135 that defines a rear face of the display window 110*c* to create a three-dimensional look to the display fixture 100 thereby more readily attracting the attention of consumers. Each of the container bins 116 can be mounted to the sheathing member 135 so that the container bins 116 are arranged in an operative position when the sheathing member 135 is installed. In some embodiments, the container bins 116 can include images, text, graphics, or a combination thereof for conveying information relating to the products 118. For example, the products 118 can be lipsticks in a variety of shades. In this example, each of the container bins 116 can display a color of a particular shade of lipstick. Each container bin 116 can retain and display lipsticks having a hue that corresponds to the hue displayed on the front of the container bins 116. For example, one container bin 116 can be colored red and contain red lipstick while a second container bin 116 can be colored pink and contain pink lipstick. This allows consumers to readily view and select from among a variety of lipstick shades from a significant distance, and then approach the display fixture 100 to obtain one or more lipsticks in a desired shade.

As another example, the products 118 can be a variety of cosmetic products, and the container bins 116 can include images of people wearing the cosmetic products retained within each respective container bin 116. This can allow a consumer to more readily view what each type of cosmetic product looks like when applied. As another example, each container bin 116 can include images of logos or brand names for the products 118 retained in each respective container bin 116. As yet another example, each container bin 116 can include textual images indicating a price of the products 118 retained in each respective container bin 116.

Still referring to FIG. 1, the horizontal shelves 112*a* and 112*b* can retain and display a variety of products. For example, a variety of apparel items, such as shirts and pants, can be folded and stacked on the shelf 112*a*. As another example, a variety of hair care products can be displayed on the shelf 112*b*. In some embodiments, the display windows 110*a-d* can include images related to the products displayed on the shelves 112*a-b*. For example, following the example above where a variety of hair care products are displayed on the shelf 112*b*, the display window 110*b* can include an image of a person's face and hair.

In accordance with some embodiments, the display windows 110 and shelves 112 are defined by the flexible sheathing members 130. For example, the display window 110*b* is defined on the top and on the sides by a flexible sheathing member 130*a* and on the bottom by a flexible sheathing member 130*b*. The sheathing member 130*a* may include an integrated vertical sheathing panel 133*a* extending along a rear of the window 110*b*. In other embodiments, the vertical sheathing panel 133*a* is not integrated with the sheathing member 130*a*, but instead includes a number of rearwardly extending tabs that are configured to be received by the apertures 146 (FIG. 2) of the internal frame structure 140. The flexible sheathing member 130*b* in this embodiment also defines the top of the display window 110*d* while the sides of the display window 110*d* are defined by flexible sheathing members 130*c* & 130*d*. In some embodiments, the flexible sheathing members 130 are configured to releasably mount to the internal frame structure 140 (not shown) as described in more detail below with reference to FIG. 2.

As previously described, the flexible sheathing members 130 can be readily removed from the internal frame structure 140 of the display fixture 100 and replaced by other sheathing members (e.g., having different shapes, colors, or images) to alter the appearance and functionality of the display fixture 100. For example, all of the flexible sheathing members 130 (FIG. 1) can be removed from a base 102 and the internal frame structure 140 and replaced with other flexible sheathing members 230 (FIG. 11) to change the size, color, or appearance of the display windows. Accordingly, a store worker can readily change the configuration of an endcap display fixture without requiring special tools for disassembly or reassembly and without the labor required to move the base 102 and frame structure 140. As another example, the flexible sheathing member 130*a* that defines the display window 110*b* (FIG. 1) for displaying products can be removed from the display fixture 100 and replaced by a flexible sheathing member having an integrated large panel for conveying information to consumers covering the area of the window 110*b*. In some embodiments, the flexible sheathing members 130 can be removed and replaced with different colored sheathing members, or sheathing members having different shapes or physical contouring. For example, the flexible sheathing member 130*b* can be removed and replaced with a flexible sheathing member that includes patterns etched into one or more of its surfaces. As another example, the flexible sheathing member 130*a* can be removed and replaced with a flexible sheathing member having rounded edges rather than sharp edges. As yet another example, the flexible sheathing member 130*a* can be removed and replaced with a flexible sheathing member that is semi-circular in shape rather than rectangular in shape.

Still referring to FIG. 1, the flexible sheathing members 130 can include textual images, graphic images, or a combination thereof relating to the products displayed by the display fixture 100. For example, the display window 110*b* can retain and display a number of pharmaceutical products and the flexible sheathing member 130*a* can include a textual image indicating designated uses of the pharmaceutical products. As another example, the flexible sheathing members 130 can include images of logos or brand names of products displayed by the display fixture 100. As another example, display fixture 100 can display a variety of hunting or camping products and the flexible sheathing members 130 can include camouflage patterns to enhance the aesthetic look of the display fixture 100 while also relating to the products displayed by the display fixture 100.

In some embodiments, the flexible sheathing members 130 can be used to retain and display products, rather than or in addition to defining display windows 110 for displaying products. For example, products can be placed on top of the flexible sheathing member 130*a*. As another example, the display fixture 100 can include a flexible sheathing member 130*e* which includes one or more hooks 132 for retaining and displaying various products. For example, the hooks 132 can retain product packages holding makeup compacts.

Still referring to FIG. 1, some embodiments of the display fixture 100 can include one or more removable sign panels 120 for conveying information relating to products displayed by the display fixture 100. For example, the display fixture 100 can include a flexible sheathing member 130*f* configured to retain the removable sign panel 120. The removable sign panel 120 can include images, text, graphics, or a combination thereof for conveying information relating to products displayed by the display fixture 100. For example, the removable sign panel 120 can include text indicating that all products displayed on the display fixture 100 are currently 40% off.

In some embodiments, the display fixture 100 can include one or more decorative models 122 to enhance the aesthetics of the display fixture 100. In some embodiments, the decorative model 122 can be related to the products displayed by the display fixture 100. For example, display fixture 100 can display various bath products and the decorative model 122 can be a rubber duck toy. As another example the decorative model 122 can be a blown up version of one of the products 118. In some embodiments, the decorative model 122 can be unrelated to the products displayed by the display fixture 100 and merely serve the purpose of enhancing the visual appeal of the display fixture 100. For example, the decorative model 122 can be a statue or other artwork. As shown in FIG. 1, the decorative model 122 can be enclosed in a case having one or more generally transparent panels so as to hinder or limit access to the decorative model 122. In some embodiments, the decorative model 122 can be supported by one or more of the flexible sheathing members 130, while in other embodiments, the decorative model 122 can be mounted directly to the internal frame structure 140.

Figure 2:
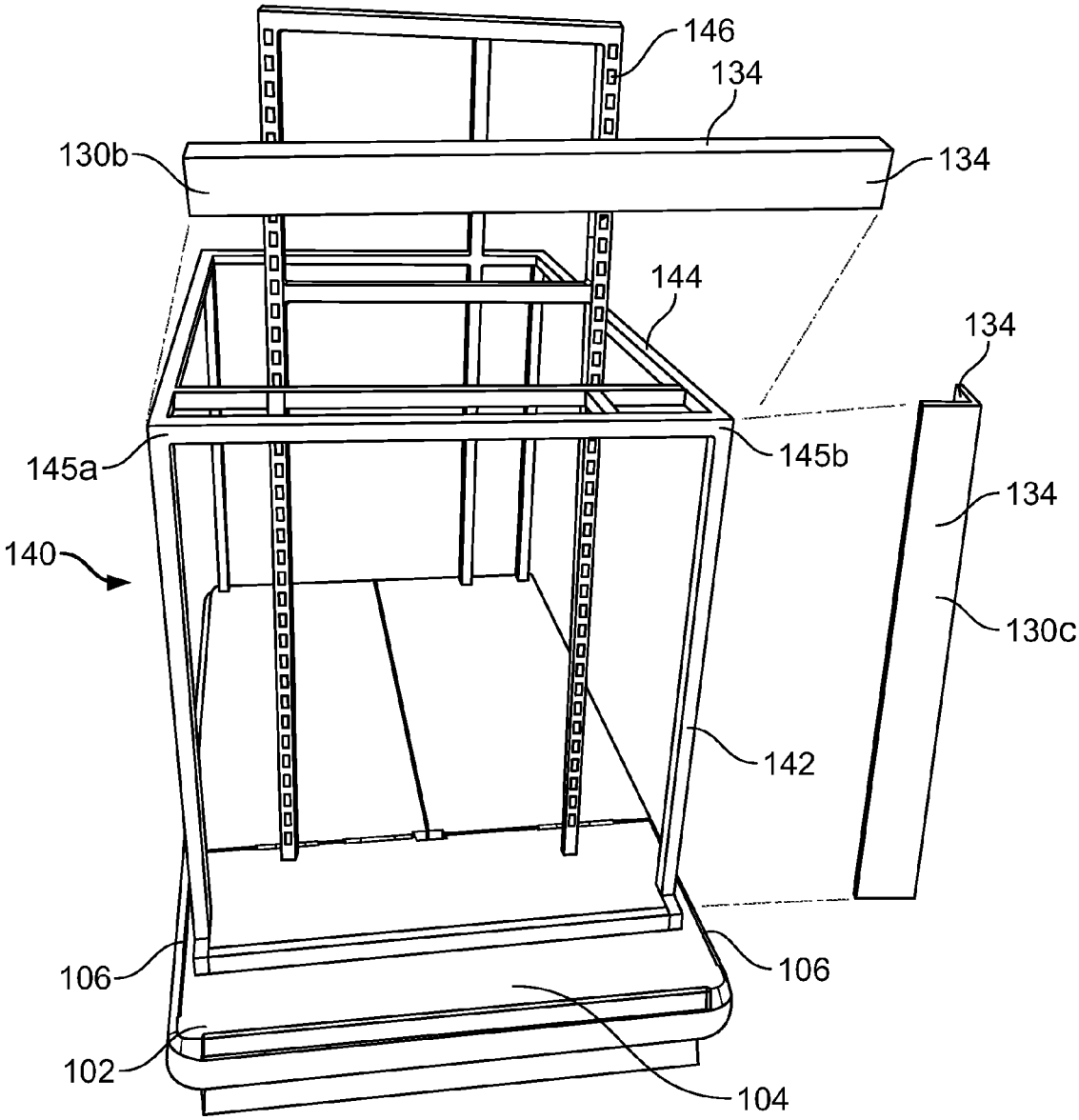
FIG. 2 is an exploded view of an internal frame structure and flexible sheathing members of a display apparatus, in accordance with some embodiments.

Still referring to FIG. 1, in accordance with some embodiments, the display fixture 100 includes the base 102 that supports the internal frame structure 140 as described in greater detail below with reference to FIG. 2. In some embodiments, the sides and front of the base 102 extend in a horizontal plane beyond the outward facing surfaces of the flexible sheathing members 130 and the internal frame structure 140 (FIG. 2). For example, as depicted in FIG. 1, the base 102 can include a front extending portion 104 which extends horizontally beyond the outward facing surfaces of the flexible sheathing members 130*c* and 130*d*. The front extending portion 104 can help to prevent damage to the display fixture 100 by preventing shopping carts from contacting the flexible sheathing members 130 or products of the display fixture 100. In some circumstances, the front extending portion 104 can contact a bottom portion of a shopping cart and prevent the shopping cart from disrupting products displayed on the display fixture or dislodging one or more of the flexible sheathing members 130 from the display fixture 100. Also, the base

102 includes side extending portions 106 (one on each side) that extend beyond the outward facing surfaces of the flexible sheathing members 130 and the internal frame structure 140 (FIG. 2).

Referring again to FIG. 1, in some embodiments, portions of the base 102 can include an upper surface that serves as a shelf of the display fixture 100. For example, a variety of baseball bats can be displayed within the display window 110*d* and be partially supported by the upper surface of the base 102. In some embodiments, the base 102 can be formed from two or more detachable pieces that can be detached from one another and coupled with other base pieces to change the size or shape of the display fixture 100. For example, an extra base piece can be added to the base 102 to extend the length of the display fixture 100. In some embodiments, the base 102 can be substantially formed from one piece or two or more non-detachable pieces.

Figure 11:
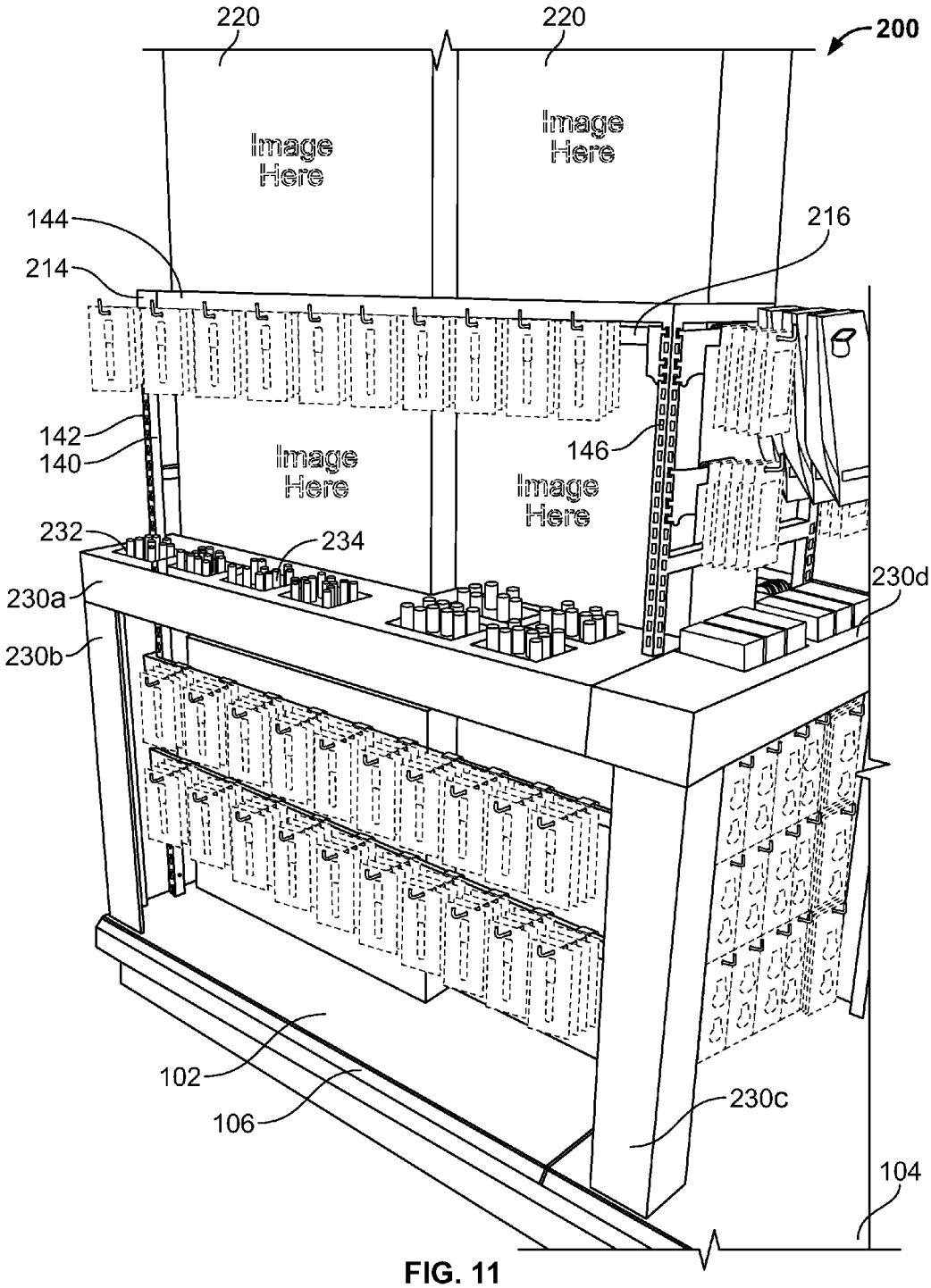
FIG. 11 is a perspective view of a display apparatus, in accordance with some embodiments.

Referring now to FIG. 2, in accordance with some embodiments, the internal frame structure 140 of the display fixture 100 is supported by the base 102. As described above, the front extending portion 104 and side extending portions 106 of the base 102 extend horizontally beyond the internal frame structure 140. The internal frame structure 140 can be constructed of metal or another suitably rigid material such as wood or high-rigidity polymers. The internal frame structure 140 can include vertical frame members 142 and horizontal frame members 144. The vertical frame members 142 in this embodiment extend upward from the base 102 and support the horizontal frame members 144. The horizontal frame members 144 connect the vertical frame members 142 to add stability to the internal frame structure 140 and to provide additional regions for receiving the previously described sheathing members 130 (FIG. 1) or 230 (FIG. 11). In some embodiments, the internal frame structure 140 can include diagonal frame members attached between the vertical frame members 142 or horizontal frame members 144 to add additional support and stability to the internal frame structure.

In some embodiments, the vertical and horizontal frame members 142 and 144 can be releasably coupled to one another to allow vertical and horizontal frame members 142 and 144 to be removed or additional frame members to be attached to the internal frame structure 140. Having removable frame members can give the internal frame structure 140 a modular design and allow for the size, shape, and appearance of a display fixture which includes the internal frame structure 140 to be readily altered.

Still referring to FIG. 2, the internal frame structure 140 can be configured to receive a plurality of flexible sheathing members (e.g. the flexible sheathing members 130 shown in FIG. 1 or flexible sheathing members 230 shown in FIG. 11), product display containers (e.g. the container bins 116 shown in FIG. 1), product display shelves, sign panels (e.g. the removable sign panel 120 shown in FIG. 1), or a combination thereof. The flexible sheathing members 130*b* and 130*c* can be configured to releasably mount to the internal frame structure 140 in a toolless manner (e.g., without the need for handheld tools). For example, the flexible sheathing member 130*c* can releasably mount to a selected one of the vertical frame members 142. As another example, the flexible sheathing member 130*b* can releasably mount to a selected one of the horizontal frame members 144. Each of the remaining sheathing members in the set shown in FIG. 1 can also be toollessly mounted to a corresponding one of the frame members 142 or 144 so as to provide an attractive and useful outer sheathing for the display apparatus 100. In circumstances in which the internal frame structure 140 includes diagonal frame members, the flexible sheathing members 130 may also be configured to releasably mount to the diagonal frame members. The flexible sheathing members 130 can be constructed of a flexible material such as plastic, cardboard, paper board, or foamcore board. In some embodiments, the flexible sheathing members 130*b-c* can include panels 134 positioned at right angles with respect to each other. In other embodiments, the angles formed by the panels 134 can be greater or less than right angles to provide a different shape for the outer sheathing of the display apparatus 100. In the example depicted in FIG. 2, the panels 134 are generally rectangular in shape. In some embodiments, the panels 134 can be shapes other than rectangular, (e.g. oval-shaped).

In some embodiments, the flexible sheathing members 130 (including the members 130*b* and 130*c* depicted in FIG. 2) can include mounting clips 136 (FIG. 3) for mounting to the internal frame structure 140. In some embodiments, each mounting clip 136 can extend inwardly toward a corresponding frame member 142 or 144 so as to be positioned opposite from an outer face of the sheathing member 130. The mounting clip 136 can include an elongated channel that frictionally engages the corresponding frame member 142 and 144. For example, the channel of the mounting clip 136 may be a generally u-shaped channel that includes opposing side walls and a bottom wall. As described in more detail below in connection with FIG. 3, when mounting to the internal frame structure 140, the opposing sidewalls and bottom wall of the channel can contact mating surfaces of the corresponding frame member 142 or 144. In some embodiments, the channel defined by the mounting clip 136 can be a shape other than u-shaped. For example, the channel can be semi-circular or v-shaped. The mounting clips allow the flexible sheathing members 130*b-c* to be readily mounted to and removed from the internal frame structure 140 without the use of handheld tools.

The mounting clips 136 can be flexible so as to form a releasable friction fit with the vertical and horizontal frame members 142 and 144. The friction fit can secure the flexible sheathing members 130*b-c* in an operative position while allowing the flexible sheathing members 130*b-c* to be readably removed from the internal frame structure 140 in a toolless manner. In some embodiments, the flexible sheathing members 130*b-c* can be removed from the internal frame structure 140 and replaced with other flexible sheathing members to alter the appearance of a display fixture that includes the internal frame structure 140. For example, the flexible sheathing members 130 (FIG. 1) may include images and product brands displayed by the display fixture 100. The flexible sheathing members 130 (FIG. 1) can be readably removed from the display fixture 100 and replaced with a second set of flexible sheathing members 230 (FIG. 11) which include different images and product brands so that the apparatus promotes a different set of products.

Accordingly, the flexible sheathing members 130 (FIG. 1) can be readily removed from the internal frame structure 140, thereby allowing a store worker to promptly change the appearance, size, and shape of the display apparatus from a first configuration 100 (FIG. 1) to a second configuration 200 (FIG. 11) without having to move or disassemble the base 102 and frame structure 140. As another example, flexible sheathing members which feature Halloween themed designs can be mounted to the internal frame structure 140 to create a display fixture for displaying Halloween costumes and other Halloween related products. The Halloween themed flexible sheathing members can then be removed from the internal frame structure 140 and replaced by other flexible sheathing members having winter themed designs to create a display fixture for displaying snowboards, skis, winter coats, and other winter related products. As yet another example, the Halloween themed flexible sheathing members can be removed from the internal frame structure 140 and replaced by flexible sheathing members having a store-colored design (e.g., red color sheathing members, or the like) to create a display fixture that can be used to display a wide variety of products, such as cosmetics, cookware, office supplies, or luggage.

Moreover, the flexible sheathing members 130 can be removed from the internal frame structure 140 in a toolless manner, thereby further increasing the efficiency at which a store worker can change the appearance, size, and shape of the display apparatus. For example, the display fixture 100 (FIG. 1) can be configured to display a selected set of products. The store worker can readily remove the flexible sheathing units 130 from the internal frame structure 140 without the use of handheld tools. The store worker can then toollessly mount a different set of flexible sheathing members (e.g. the flexible sheathing members 230 shown in FIG. 11) to the internal frame structure 140 to create the display fixture 200 (FIG. 11) for displaying a second selected set of products. The ease with which the appearance of a display fixture can be altered by removing and replacing sheathing members allows a store worker to readily adjust the appearance of the display fixture to correspond to a variety of different sets of products.

In some embodiments, the vertical and horizontal frame members 142 and 144 can include apertures 146 for receiving tabs or hooks of the flexible sheathing members or other product display fixtures. For example, the apertures 146 can be configured to receive tabs of one or more sheathing panels (e.g. the vertical sheathing panel 133*a* shown in FIG. 1). A front face of a sheathing panel can support product display hooks for displaying various product packages. The sheathing panel can include a number of tabs extending from a rear face of the sheathing panel. The tabs can be configured to be received by the apertures 146 for securing the sheathing panel in an operative position on the internal frame structure 140.

Figure 3:
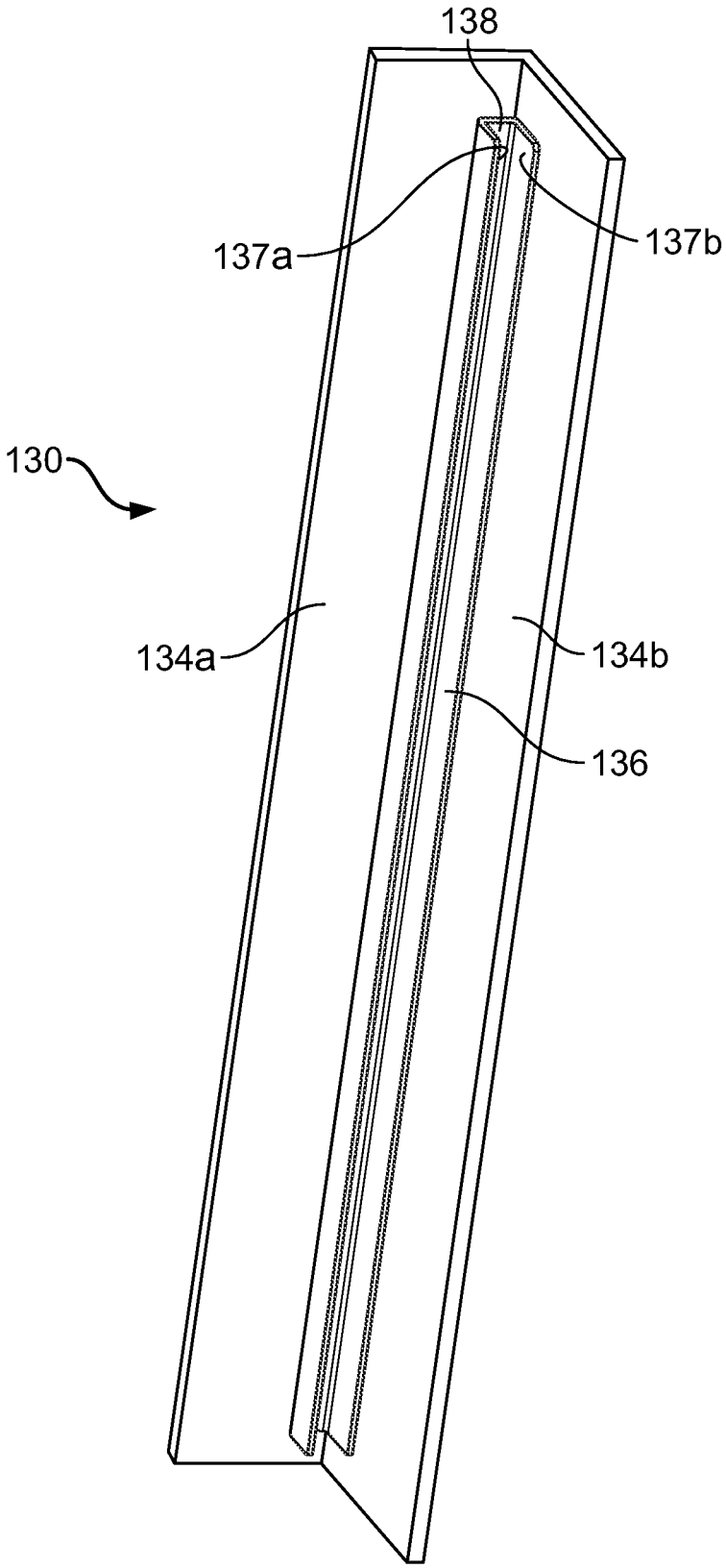
FIG. 3 is a perspective view of a flexible sheathing member, in accordance with some embodiments.
Figure 4:
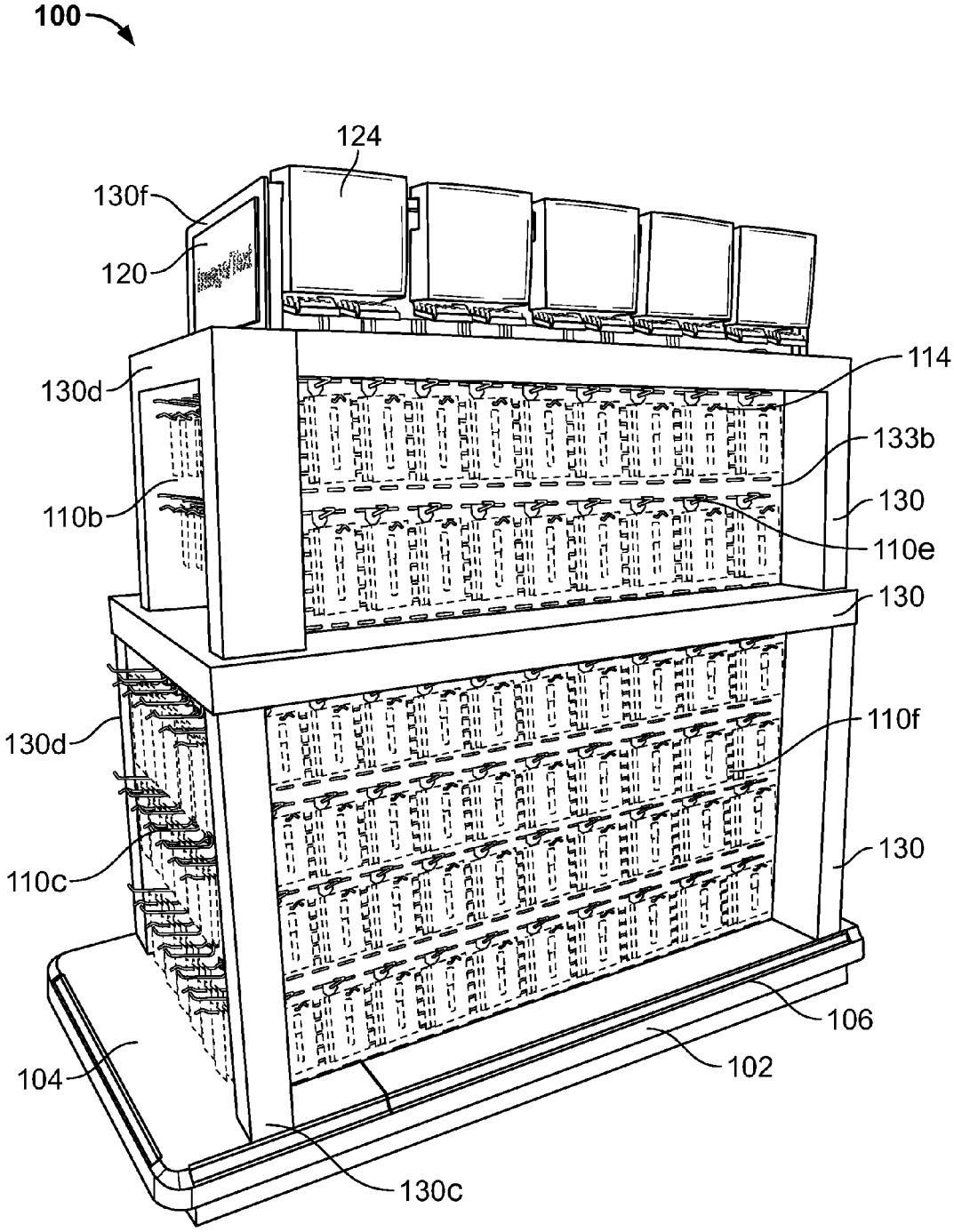
FIG. 4 is a perspective view of the display apparatus of FIG. 1.
Figure 5:
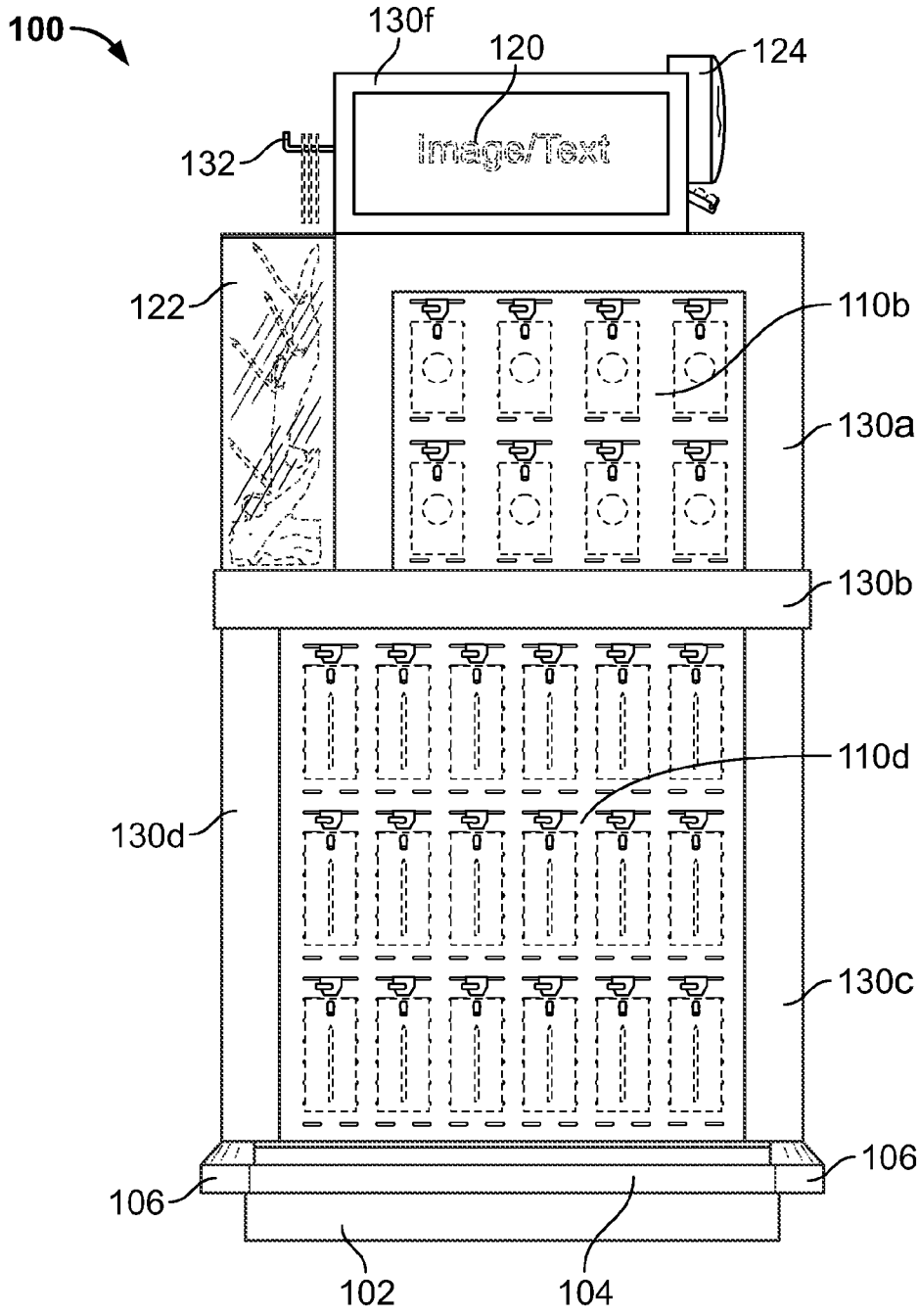
FIG. 5 is a front view of the display apparatus of FIG. 1.
Figure 6:
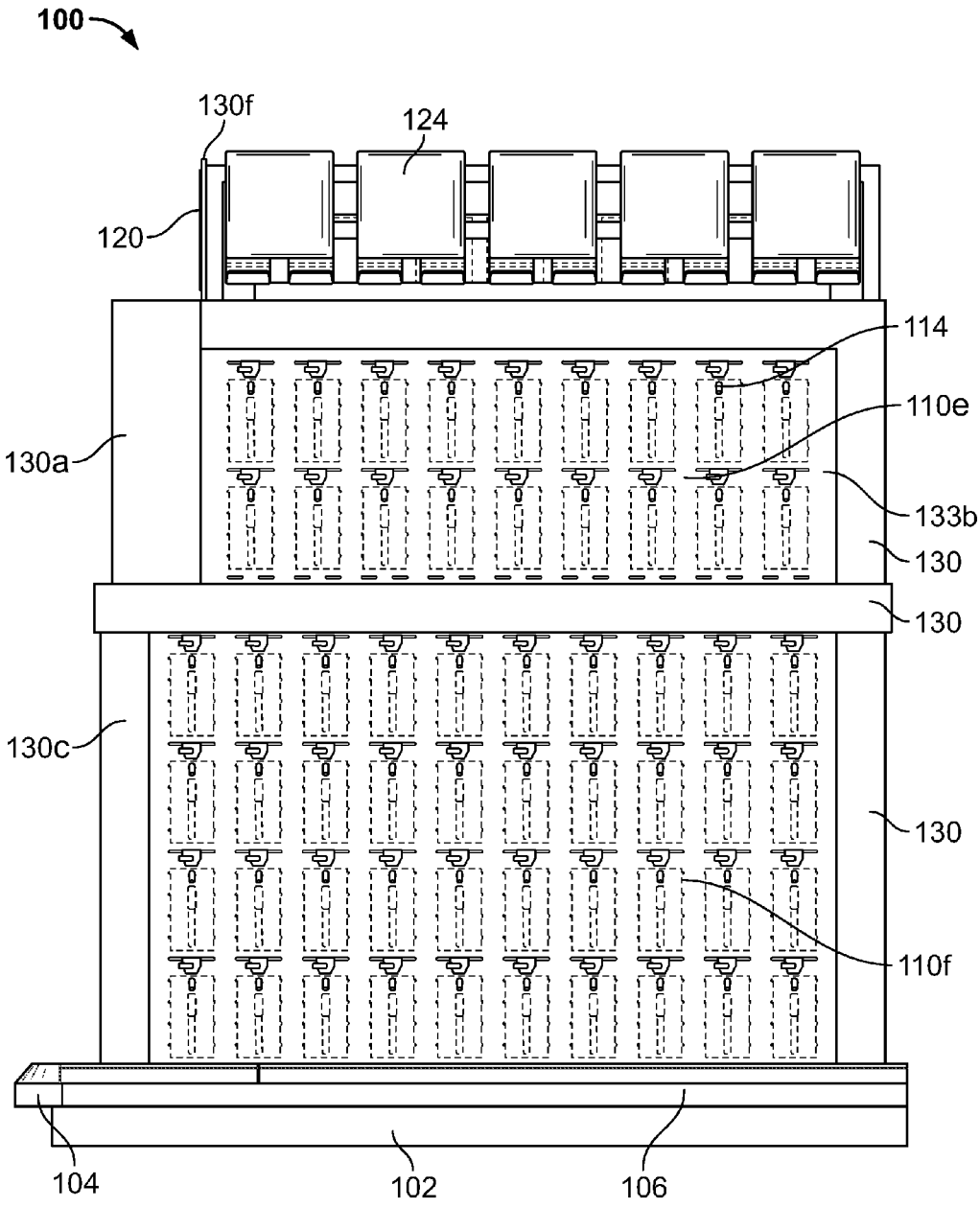
FIG. 6 is a side view of the display apparatus of FIG. 1.

Referring now to FIG. 3, some embodiments of the flexible sheathing members 130 depicted in FIG. 1 (and the members 230 depicted in FIG. 11) can include generally rectangular shaped panels 134*a-b* which form a right angle with respect to one another. Each flexible sheathing member 130 may also includes one or more mounting clips 136 which are affixed to one or more of the panels 134*a-b*. As previously described, the mounting clip 136 can define a channel 138. In some embodiments, the channel 138 is defined by opposing side walls 137*a-b* and a bottom wall 139 of the mounting clip 136. The opposing side walls 137*a-b* and the bottom wall 139 are configured to engage the sides of a corresponding frame member 142 or 144 of the frame structure 140, as shown in FIG. 2.

The opposing side walls 137*a-b* and the bottom wall 139 can form a friction fit with a vertical or horizontal frame member 142 or 144 to secure the flexible sheathing member 130 in an operative position with respect to the vertical or horizontal frame member 142 or 144. The mounting clip 136 allows the flexible sheathing member 130 to be toollessly mounted to the vertical or horizontal frame member 142 or 144 by slidably engaging the vertical or horizontal frame member 142 or 144. The friction fit allows the flexible sheathing member 130 to be promptly removed from the vertical or horizontal frame member 142 or 144 and replaced by another sheathing member having a different appearance.

In some embodiments, the mounting clip 136 can include an adjustable-width channel 138, which permits a user to change the width of the bottom wall 139. For example, the bottom wall 139 can be formed from two pieces that are slideable with relation to each other. The mounting clip 136 can include one or more hand-releasable fasteners for holding the two pieces of the bottom wall 139 in position with relation to each other. By adjusting the hand-releasable fasteners, a user can increase or decrease the width of the channel 138 by adjusting the position of the pieces of the bottom wall 139 with relation to each other. The adjustable-width channel 138 of the mounting clip 136 enables the sheathing member 130 to mount to vertical and horizontal frame members 142 and 144 having different widths.

In some embodiments, the flexible sheathing member 130 can include more than one mounting clip 136 to allow the flexible sheathing member 130 to be secured to more than one vertical or horizontal frame member. For example, referring to FIG. 2, the flexible sheathing member 130*c* can be mounted to the vertical frame member 142 that forms part of the corner 145*b*. The flexible sheathing member 130*c* can include three mounting clips to allow the flexible sheathing member 130*c* to be secured to both of the horizontal frame members 144 and the vertical frame member 142 that form the corner 145*b*. Having multiple mounting clips allows the flexible sheathing member 130 to form a more secure coupling to an internal frame structure by allowing the flexible sheathing member 130 to engage more than one vertical or horizontal frame member at one time. In some embodiments, the flexible sheathing member 130 can include multiple mounting clips for engaging a single vertical or horizontal frame member. For example, the flexible sheathing member 130 can include three co-linear mounting clips for engaging a single vertical frame member.

Referring now to FIGS. 4-10, in accordance with some embodiments, the display fixture 100 includes a front face (see FIG. 5) and two side faces (see FIGS. 6 and 8) which include a number of display windows 110 defined by flexible sheathing members 130. The flexible sheathing members 130 are mounted to a rigid internal frame structure 140 as described above with reference to FIG. 2. The internal frame structure is supported by the base 102. The display windows 110 can be configured to display a variety of products and product packages. For example, referring to FIG. 4, a display window 110*e* can include a sheathing panel 133*b* that retains a plurality of hooks 114 for supporting and displaying a variety of products and products packages (e.g. cosmetic products). In some embodiments, the display fixture 100 can include a number of display shelves for retaining products. In some embodiments, the display fixture 100 can include product containers for retaining and displaying products (e.g. the container bins 116 and product containers 124). In some embodiments, the display fixture 100 includes one or more sign panels, such as the removable sign panel 120, for conveying information related to products displayed by the display fixture 100.

Figure 7:
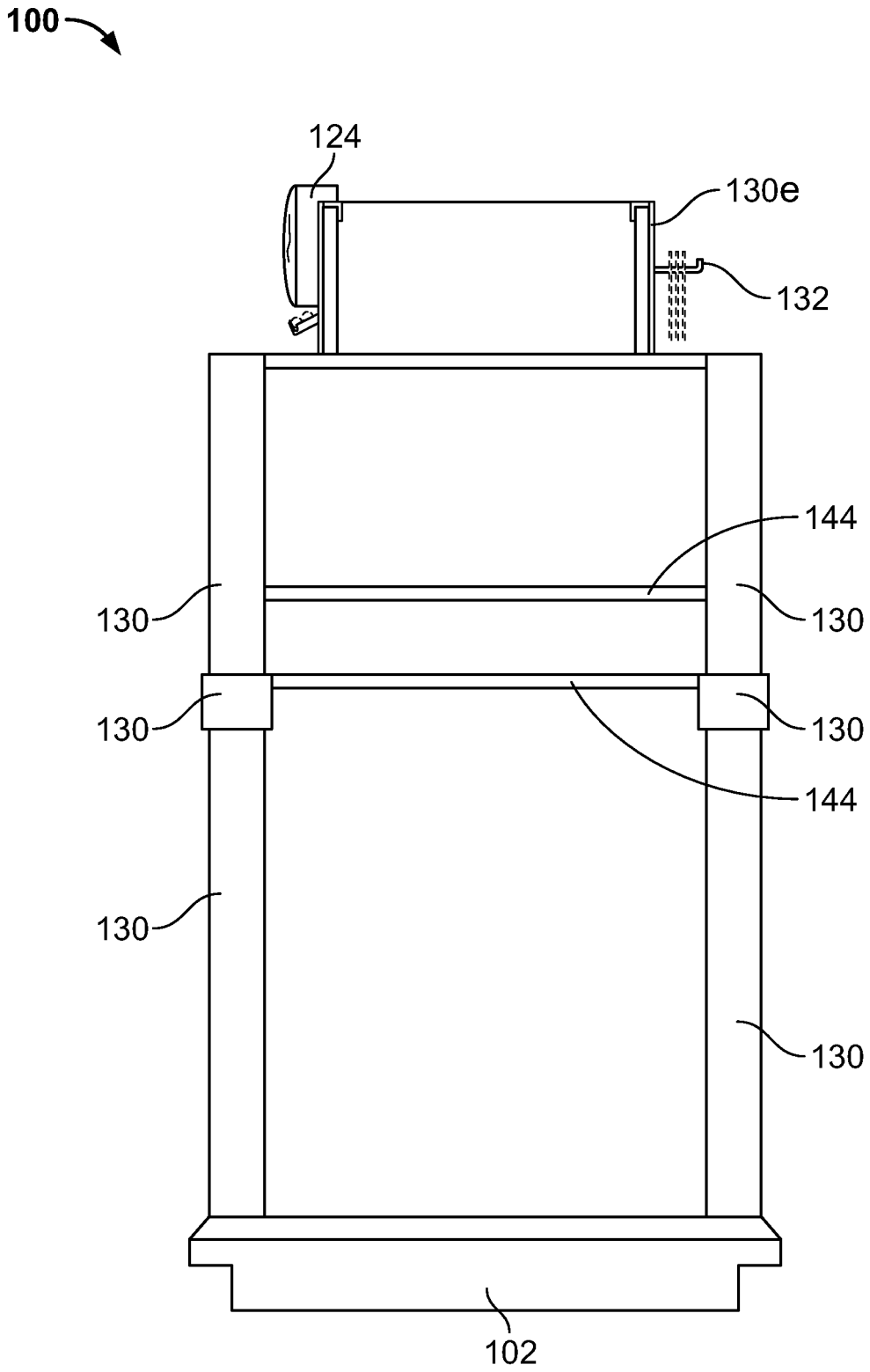
FIG. 7 is a rear view of the display apparatus of FIG. 1.
Figure 8:
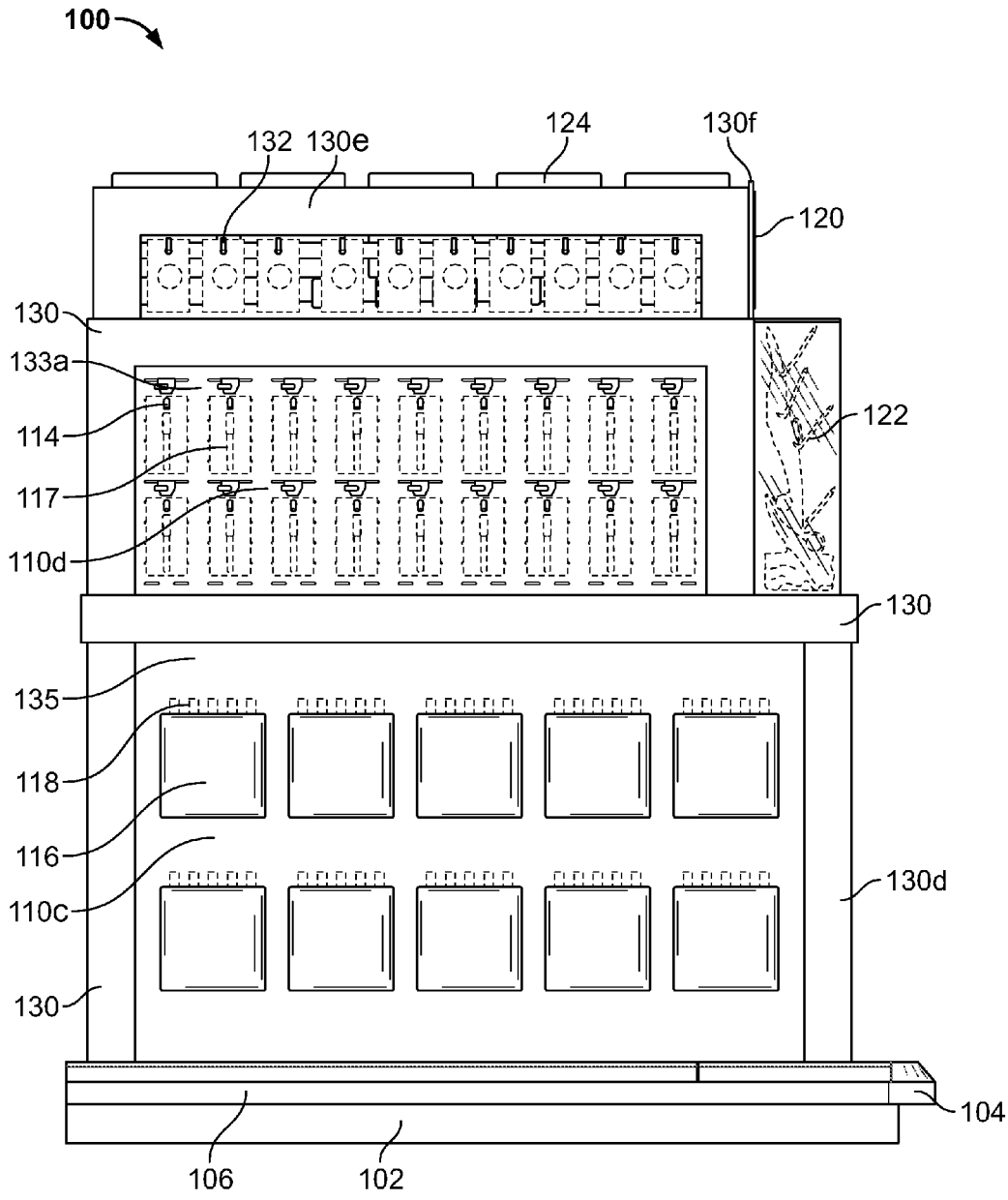
FIG. 8 is a side view of the display apparatus of FIG. 1.

In accordance with some embodiments, the display fixture 100 includes a rear face (see FIG. 7). In the embodiment depicted, the rear face is configured to be positioned against a wall or an end of a retail shelving unit to serve as an endcap to the shelving unit at the end of a shopping aisle. In some embodiments, the rear face of the display fixture 100 can include means for coupling the display fixture to an end of a retail shelving unit. In other embodiments, the rear face can include display windows or shelves in a similar manner as the front and side faces.

Figure 9:
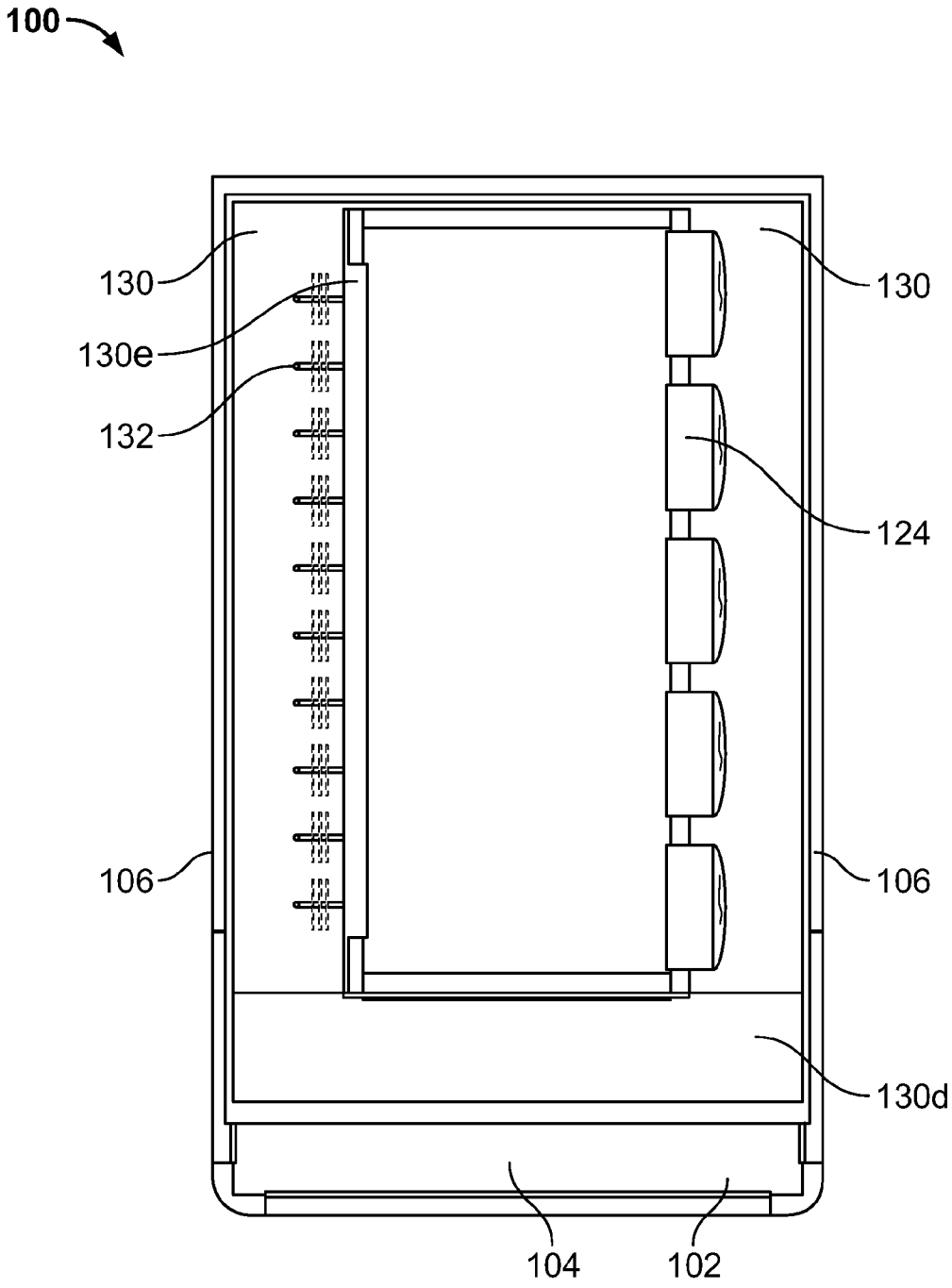
FIG. 9 is a top view of the display apparatus of FIG. 1.
Figure 10:
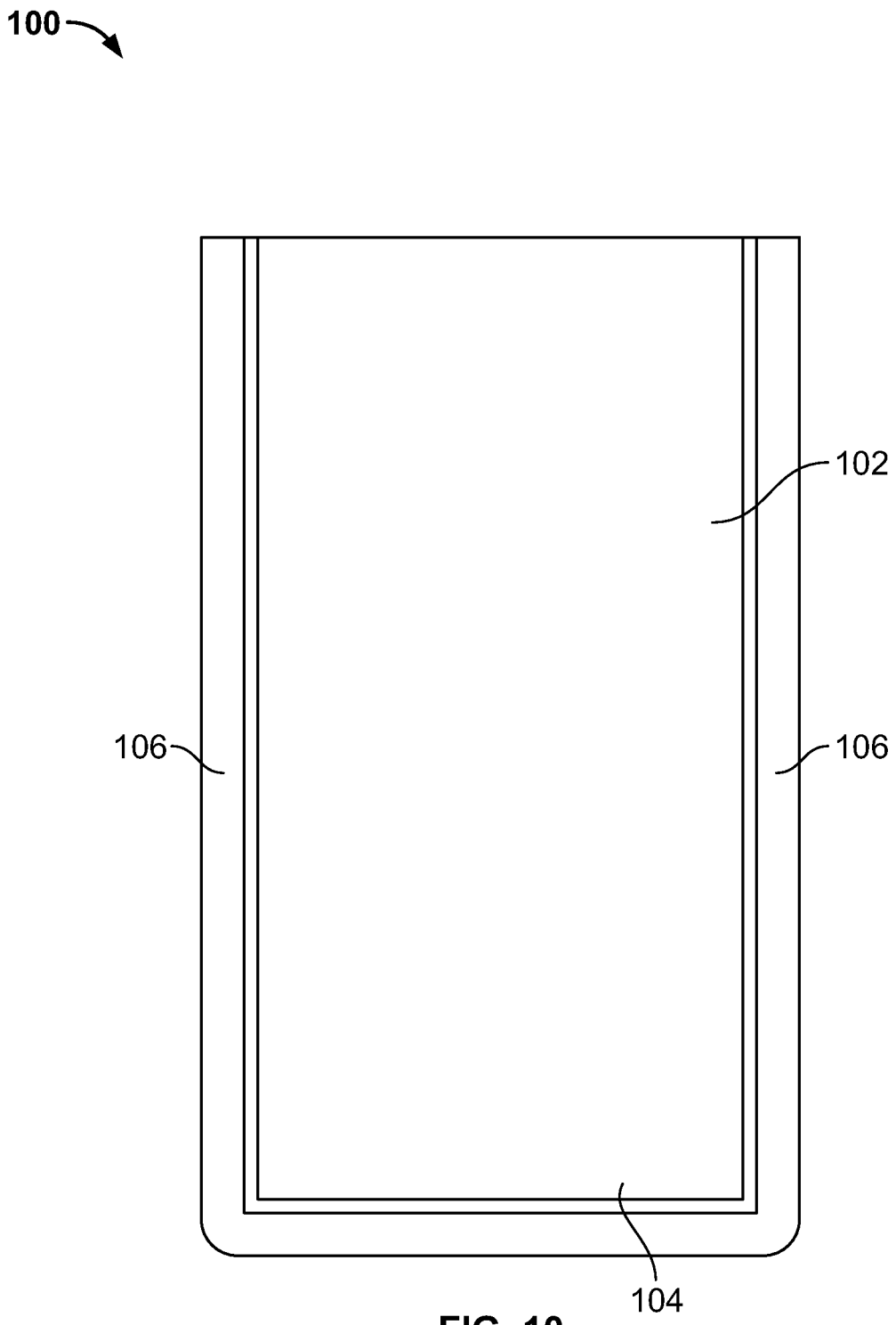
FIG. 10 is a bottom view of the display apparatus of FIG. 1.

In accordance with some embodiments, the display fixture 100 includes a bottom face defined by the base 102 (as shown in FIG. 10). Because the front extending portion 104 and the side extending portions 106 are wider than the frame structure 140 and the sheathing 130, the upper portion of the display fixture 100 may not be viewable from the bottom face. Furthermore, the display fixture 100 may include a top face (as shown in FIG. 9). In some embodiments, the top face can expose portions of the internal frame structure 140. In other embodiments, the internal frame structure 140 is not visible by a user facing the top face of the display fixture 100.

Referring now to FIG. 11, in accordance with some embodiments, the flexible sheathing members enable a store worker to readily change the configuration of the display fixture from a first configuration 100 (FIG. 1) to a second configuration 200 (FIG. 11) without requiring handheld tools. In this second configuration, the display fixture 200 includes a plurality of flexible sheathing members 230*a-d* mounted to the internal frame structure 140 as described above with reference to FIG. 2. The internal frame structure 140 includes vertical frame members 142 and horizontal frame members 144 which extend between the vertical frame members 142 as described above with reference to FIG. 2. The internal frame structure is supported by the base 102. A store worker can create the display fixture 200 by mounting the flexible sheathing members 230 to the internal frame structure 140.

In some embodiments, the display fixture 200 includes one or more removable sign panels 220 for conveying information relating to products displayed by the display fixture 200. For example, the display fixture 200 can display a variety of cosmetic products and the removable sign panels 220 can display information on suggested uses for the products, or images that demonstrate suggested combinations of products.

In some embodiments, the display fixture 200 includes a plurality of hooks 214 supported by horizontal supports 216. The hooks 214 can be configured to retain and display products and products display packages. For example, the hooks can retain a variety of gift cards. As another example, the hooks 214 can retain product packages that contain makeup application brushes. In some embodiments, the hooks 214 are supported by one or more horizontal supports 216. The horizontal supports 216 are configured to releasably couple to the internal frame structure 140. For example, the internal frame structure 140 can include apertures 146 for receiving tabs or support hooks of the horizontal supports 216. The tabs or support hooks can be inserted into the apertures 146 to secure each horizontal support 216 in an operative position. The tabs or support hooks allow the horizontal supports 216 to be readily removed from the display fixture 200 without the use of handheld tools. In some embodiments, the horizontal supports 216 can be secured to the display fixture 200 through fasteners other than tabs and apertures. In some embodiments, the hooks 214 can mount directly to the vertical or horizontal supports 142 and 144 of the internal frame structure 140. In some embodiments, the hooks 214 can be mounted to one or more of the flexible sheathing members 230*a-d*. In some embodiments, the horizontal supports 216 can be mounted to the flexible sheathing members 230*a-d*.

Still referring to FIG. 11, in accordance with some embodiments, one or more of the flexible sheathing members 230 may define cavities 232 for receiving retail display trays 234. The retail display trays 234 can retain and display a variety of retail products. For example, the retail display trays 234 can retain a variety of lipstick tubes while the products above (suspended from the hooks 214) retain eyeliner pencils from the same brand or color scheme. The retail display trays 234 can be releasably secured in an operative position within the cavities 232. For example, the retail display trays 234 can be dropped down into the cavities 232 to rest within the cavities 232. Each display tray 234 can include an outer rim along an upper edge so as to rest upon a cavity rim that defines the cavity 232. By being releasably mounted to the flexible sheathing members 230, the retail display trays 234 can be readily removed from the display fixture 200 without the use of handheld tools and replaced by other display trays. In some embodiments, the retail display trays 234 can be removed from the display fixture 200 and replaced with flat panels so as to form a shelf for displaying products. For example, the retail display trays 234 can be removed from the flexible sheathing member 230*a* and replaced with flat panels. The flat panels, along with the upper surface of the flexible sheathing member 230*a* can define a shelf upon which products can be displayed.

The retail display trays 234 can display products related to images or text displayed by the removable sign panels 220. For example, the removable sign panels 220 can include images of people wearing a variety of sunglasses so as to attract the attention of consumers from a distance. The retail display trays 234 can retain sunglasses corresponding to the sunglasses displayed by the removable sign panels 220 in close proximity to the removable sign panels 220 to allow a consumer to readily access, obtain, and purchase a desired pair of sunglasses. As another example, the removable sign panels 220 can include blown up images of various cosmetic products such as lipsticks and eye shadows, as well as color swatches of various shades of cosmetic products. The retail display trays 234 can retain the cosmetic products displayed by the removable sign panels 220 in a variety of shades to allow consumers to readily access, obtain, and purchase the cosmetic products depicted on the removable sign panels 220.

A number of embodiments of the invention have been described. Nevertheless, it will be understood that various modifications may be made without departing from the spirit and scope of the invention. Accordingly, other embodiments are within the scope of the following claims.

What is claimed is:

1. An endcap display apparatus for abutment with an end of a retail shelving unit, the apparatus comprising:

a lower support platform having a rear face to abut with an end of a shelving unit and provide an endcap for the shelving unit;

a rigid internal frame extending upward from the lower support platform, the rigid internal frame including a plurality of vertical and horizontal frame members; and a first set of flexible external sheathing members toollessly mounted to the rigid internal frame so that the first set of flexible external sheathing members substantially conceal the rigid internal frame and provide one or more product display windows or product display surfaces to receive a plurality of products;

wherein each of the first set of flexible external sheathing members is bendable, each of the first set of flexible external sheathing members includes at least one toolless mounting connector to releasably engage the first set of flexible external sheathing members to a corresponding one of the vertical and horizontal frame members, the first set of flexible sheathing members includes at least one single piece panel folded to substantially conceal at least two sides of a first linear member of the rigid internal frame, and the at least one single piece panel having its corresponding toolless mounting connector positioned at a vertex thereof.

2. The apparatus of claim 1, wherein the rigid internal frame is configured to receive a second set of flexible external sheathing members that toollessly mount to the rigid internal frame in place of the first set of flexible external sheathing members, the second set of flexible external sheathing members having a different appearance than the first set of flexible external sheathing members.

3. The apparatus of claim 2, wherein the second set of flexible external sheathing members define one or more product display structures that have a different appearance than the one or more product display structures defined by the first set of flexible external sheathing members.

4. The apparatus of claim 3, wherein the one or more product display structures defined by the second set of flexible external sheathing members includes at least one cavity to receive a drop-in product tray having an upper opening to access products displayed therein, and the at least one cavity receives the drop-in product tray.

5. The apparatus of claim 1, wherein the toolless mounting connector of each of the first set of flexible external sheathing members comprises a channel with flexible side walls that slidably couple with the corresponding one of the vertical and horizontal frame members.

6. The apparatus of claim 5, wherein the toolless mounting connector of each of the first set of flexible external sheathing members is arranged on an inner surface of each of the first set of flexible external sheathing members that is opposite an exterior surface of each of the first set of flexible external sheathing members.

7. The apparatus of claim 1, wherein the lower support platform comprises a floor-mounted base, the base having a length and a width substantially greater than the rigid internal frame and the first set of flexible external sheathing members mounted thereto so that the base defines at least a front extending portion and side extending portions of the base that extend outwardly beyond the rigid internal frame and the first set of flexible external sheathing members mounted thereto.

8. A product display apparatus comprising:

a base deck;

an internal frame structure extending upwardly from the base deck and including an assembly of rigid frame elements coupled to one another;

flexible covering panels slidably and releasably engaged with the rigid frame elements so that the flexible covering panels substantially cover the internal frame structure and define a plurality of exterior surfaces to receive and display products, wherein the flexible covering panels are each bendable; and friction-fit mounting channels coupled to the flexible covering panels opposite the exterior surfaces so as to slidably and releasably mount the flexible covering panels to the internal frame structure in a toolless manner;

wherein the base deck has a length and a width substantially greater than the internal frame structure and the flexible covering panels mounted thereto, thereby defining a front extending portion and side extending portions of the base deck that extend outwardly beyond the internal frame structure and the flexible covering panels mounted thereto, the flexible covering panels include a first covering panel having folded portions concealing at least three lengths of rigid frame elements to form a display window framed by the first covering panel, the first covering panel additionally comprises a vertical, substantially planar portion extending along a rear of the display window between the folded portions, and the first covering panel is formed as a single piece.

9. The apparatus of claim 8, wherein each of the flexible covering panels is coupled to at least one of the friction-fit mounting channels, each of the friction-fit mounting channels comprising flexible side walls that slidably couple with a corresponding frame member of the internal frame structure.

10. The apparatus of claim 8, wherein the flexible covering panels comprise a first set of flexible covering panels, and the internal frame structure is configured to receive a second set of flexible covering panels, which, slidably and releasably engage with the internal frame structure in place of the first set of flexible covering panels, the second set of flexible covering panels having different exterior surfaces than the first set of flexible covering panels.

11. The apparatus of claim 10, wherein the first set of flexible covering panels define one or more product display surfaces or product display windows having a different appearance from one or more product display surfaces or product display windows defined by the second set of flexible covering panels.

12. The apparatus of claim 11, wherein the one or more product display surfaces or product display windows defined by the second set of flexible covering panels includes at least one cavity, the apparatus further comprises a drop-in product tray having an upper opening to access products displayed therein, and the at least one cavity receives the drop-in product tray.

13. The apparatus of claim 1, wherein the rigid internal frame structure extends from a surface of the lower support platform.

14. The apparatus of claim 1, wherein the rigid internal frame structure is supported by the lower support platform.

15. The apparatus of claim 1, wherein the first set of flexible external sheathing members includes members each wrapping around at least a portion of the rigid internal frame structure such that the members substantially conceal the rigid internal frame.

* * * * *